United States Patent [19]

Okutsu et al.

[11] 4,228,234

[45] Oct. 14, 1980

[54] METHOD FOR MAINTAINING THE DEVELOPMENT ACTIVITY OF A PHOTOGRAPHIC LITHOGRAPHIC DEVELOPER CONSTANT

[75] Inventors: Eiichi Okutsu; Katsumi Hayashi, both of Minami-ashigara, Japan

[73] Assignee: Fuji Photo Film Co., Ltd., Minami-ashigara, Japan

[21] Appl. No.: 873,751

[22] Filed: Jan. 30, 1978

[30] Foreign Application Priority Data

Jan. 28, 1977 [JP] Japan ..... 52-8520
Feb. 15, 1977 [JP] Japan ..... 52-15117

[51] Int. Cl.[2] ..... G03C 5/30

[52] U.S. Cl. ..... 430/399; 430/265; 430/268

[58] Field of Search ..... 96/50 A, 66 R, 66.3; 430/399, 265, 268

[56] References Cited

U.S. PATENT DOCUMENTS 4,025,344 5/1977 Allen et al. ..... 96/50 A
4,081,280 3/1978 Corluy et al. ..... 96/50 A

FOREIGN PATENT DOCUMENTS 2004893 8/1971 Fed. Rep. of Germany ..... 96/50 A
1313796 4/1973 United Kingdom ..... 96/50 A

OTHER PUBLICATIONS

Mason, Photographic Processing Chemistry, pp. 138–141, 164–170, and 180–181, 1976.
Ilford, Manual of Photography, pp. 410–414, 1958.
Sincius, Litho Processing: Its Finest Hour, TACA Meeting, 5/1976.
Dupont: Quality Control, pp. 1–43, 12/1975.
Cronolith, Blender & Chemistry Systems, 3/1976.

*Primary Examiner*—Mary F. Downey
*Attorney, Agent, or Firm*—Sughrue, Rothwell, Mion, Zinn and Macpeak

[57] ABSTRACT

A method for processing silver halide lithographic photosensitive materials with a lithographic developer using an automatic developing machine, the improvement comprising maintaining constant the development activity of the lithographic developer by adding supplemental amounts of two kinds of replenishers to the lithographic developer with a replenisher (RD) being employed to compensate for the decrease in the development activity of the lithographic developer resulting from the development-processing of lithographic photosensitive materials and a replenisher (RO) being employed to compensate for the decrease in the development activity of the lithographic developer resulting from the passage of time, where replenishers (RD) and (RO) differ in free sulfite ion concentrations, bromide ion concentrations and pH, wherein the method comprises adding a supplemental amount of replenisher (RD) during the development-processing operation as herein defined and, prior to the start of each development-processing operation, adding a supplemental amount of replenisher (RO) as herein defined.

8 Claims, 2 Drawing Figures

METHOD FOR MAINTAINING THE DEVELOPMENT ACTIVITY OF A PHOTOGRAPHIC LITHOGRAPHIC DEVELOPER CONSTANT

BACKGROUND OF THE INVENTION

1. Field of the Invention

The present invention relates to a method of maintaining the development activity of a photographic lithographic developer employed in an automatic developing machine constant and, more particularly, it is concerned with an improvement in a method of maintaining the development activity constant by using two kinds of replenishers differing in free sulfite ion concentrations, bromide ion concentrations and pH.

2. Description of the Prior Art

When photographic processings are carried out on an industrial scale, it becomes necessary to control various development process conditions, for instance, temperature, time, agitation, developer, development activity, etc., used.

In order to control development activity, a supplemental amount of a developer has been added to a developer solution being used for every photosensitive material processed so as to maintain the development activity constant. This method is, in general, called "replenishment" in the photographic art. Therefore, the present invention relates to a method of replenishing a photographic lithographic developer.

The activity of the developer decreases principally due to the following factors:

(a) Development reactions taking place at the time of the development-processing of films (which will be described hereinafter as "processing exhaustion" for brevity) affect the developer activity. Namely, development of films causes various chemical effects to occur in the developer used. Examples of such effects include a decrease in the concentration of the developer, an increase in the concentration of the oxidation products of the developing agent accompanying the above-described decrease in developer concentration, and the liberation of halide ions from the silver halide present in the developed films into the developer used.

(b) Natural deterioration occurs in the developer stored in a tray or a tank, and aerial oxidation of the developer occurs spontaneously by reaction with oxygen in the air (which will be described hereinafter as "time-passage exhaustion" for brevity).

When development-processing using an automatic developing machine is allowed to continue for a long time of several days to several months, both factors (a) and (b) above take place causing a decrease in the development activity of the developer used.

Since each of these two factors influences the developer in individual and different ways, an assumption regarding the relative extents of the influence exerted by the two factors described above on the developer must be made so that the composition of replenisher to be added can be determined.

Where a number of films are development-processed successively on a regular basis during the twenty-four hours of every day using an automatic developing machine which is operated continuously, a supplemental amount of the developer is added for every processing depending on the quantity consumed by the previous processing. That is to say, since the rate of consumption of the developer can be regarded as approximately constant on such an occasion, satisfactory results can be achieved by addition of replenisher to compensate for processing exhaustion for the processing of each film in the amount necessary to replenish for the consumption of the developer occurring in the processing of each film.

However, in operation, an automatic developing machine is not used continuously, for example, the processing of films is stopped at night or over the weekend. Therefore, the factor (b) described above also influences the developer used. Such being the case, if only a replenisher to compensate for process exhaustion is added, the development activity of the developer cannot be maintained constant.

In photographic development-processing which has been predominantly carried out in the past, the quantity of the replenisher to compensate for process exhaustion to be added has been determined on the basis of the amount of developed silver halide present in the developed film, which depends upon, for example, the size of the film developed, the blackened area of the film developed, the kind of film developed and the characteristic of the developed image (e.g., whether the image is positive or negative).

The photographic speed of the developer to be used should be evaluated before processing by measuring the blackened density which is obtained by developing a control film strip having a latent image therein due to a prior exposure to light with an exact exposure, with the developer. The quantity of replenisher to be added can be adjusted on the basis of the change in the density of the developed image formed on the control film strip. When the blackened density of the control film strip obtained is lower than the initial value, replenisher should be added to the developer.

In addition, replenishment to compensate for the decrease in the development activity occurring in the developer resulting from the passage of time has been conventionally carried out by adding a replenisher having a composition similar to or different from that of the replenisher used to compensate for process exhaustion in an amount determined by the blackened density of a control film strip in a similar manner to the case of deterioration caused by the development-processing. Using this approach, however, only the photographic speed of the developer can be restored to the initial level.

In the replenishing method to compensate for deterioration due to the passage of time as described above, the amount to be supplemented has been determined by trial and error. Therefore, the determination of the optimum amount to be supplemented requires a lot of work and a long period of time and, further, there is a great concern that photographic characteristics such as the quality of the dots and the half-tone gradation related to the tone reproduction of the original image cannot be restored completely to the level obtained using a fresh developer, even though the sensitivity can be restored to the initial level by the addition of replenishers. More specifically, it is impossible to restore the development activity accurately to the level obtained using a fresh developer in accordance with the replenishing method described above.

Moreover, an automatic replenishing system for the developer is disclosed in Japanese Patent Application (OPI) No. 5436/1971 (corresponding to British Patent No. 1,313,796), wherein the content of halides present in the developer and the concentration of the developer are monitored and the information obtained thereby is analyzed, followed by the appropriate use of two kinds of replenishers in which the concentrations of halide ions in each corresponds to the requirements obtained from the analysis. In this replenishment system, two kinds of solutions having different halide ion concentrations are employed. One contains a low concentration of halide ions. The other contains a high concentration of halide ions; that is to say, almost the same concentration as that desired in the developer. The replenisher with a lower concentration of halide ion may be added in a conventional manner, namely, depending on the amount of films passed through the developer. The other replenisher having a higher concentration of halide ion may be added when restoration of the development activity lost by aerial oxidation is essential, but the concentration of halide ion must be maintained as it is without change, which occurs sometime after the use of the developer. However, such an automatic replenishing system possesses serious disadvantages that the apparatus employed as the monitor is, in general, very expensive and the maintenance of the apparatus requires much time and labor.

Methods for replenishment by adding replenishers to compensate for process exhaustion and to compensate for time-passage exhaustion where the components of the replenishers are different are disclosed in German Patent Application (OLS) No. 2,004,893 and in U.S. Pat. No. 4,025,344.

However, in each of these methods, the disclosure is of the addition of replenishers where the components of the replenisher to compensate for exhaustion due to processing and the components of the replenisher to compensate for exhaustion due to ageing, which occurs during operation of the automatic developer machine, are different. No considerations are taken in these methods for the time-passage exhaustion which also occurs when the automatic developing machine is turned off and operation is suspended.

Where the suspension time is short, i.e., the automatic developing machine is turned off for a short period of time, the time-passage exhaustion which occurs during the suspension of the automatic developing machine can be neglected. However, where the suspension time continues for a long period of time, the time-passage exhaustion during the suspension must be considered. Especially, when the developer used is a lithographic developer, processing in a stable manner would not be achieved, if one neglects the time-passage exhaustion which occurs during the time of suspension, when the automatic developing machine is turned off and not operated.

Since the change in the composition of the developer due to ageing mainly comprises a decrease in free sulfite ion concentration, therefore, this change in developer composition does not cause a change to occur in visual sensitivity. However, with lithographic development, the dot quality is affected greatly by the decrease in free sulfite ion concentration and if exhaustion due to ageing which occurs during suspension of operation is neglected, it is impossible to maintain the true development activity of the developer constant.

The true development activity can be only maintained constant when compensation for the time-passage exhaustion of the developer, particularly a lithographic developer, which occurs during a suspension of the automatic developing machine is made.

SUMMARY OF THE INVENTION

Accordingly, a first object of the present invention is to provide a practical method for replenishing a developer so that the activity of a developer may be maintained constant under any conditions concerning the quantity of films already treated, wherein various defects as described above in the prior art replenishing processes to compensate for time-passage exhaustion occurring in the developer by processing of films can be eliminated.

A second object of the present invention is to provide a simple replenishing method for a developer to compensate for time-passage exhaustion occurring in the developer, which does not require the use of personnel having a large amount of experience.

A further object of the present invention is to provide a simple and practical replenishing method for a lithographic developer wherein the exhaustion due to the passage of time occurring in a so-called infectious developer, which is employed for the development of lithographic silver halide photographic materials, can be compensated for and the true development activity thereof can be always maintained constant by adding a replenisher appropriate to compensate for exhaustion due to the passage of time, which has a composition different from that of the replenisher appropriate to compensate for exhaustion due to the development-processing, in a simple and practical manner.

The above-described objects are attained by a method for automatically processing silver halide lithographic photosensitive materials with a lighographic developer using an automatic developing machine, wherein the improvement comprises maintaining constant the development activity of the lithographic developer by adding supplemental amounts of two kinds of replenishers to the developer, a replenisher (RD) being employed to compensate for the decrease in the development activity resulting from the development-processing of the lithographic photosensitive materials and a replenisher (RO) being employed to compensate for the decrease in the development activity resulting from the passage of time, where replenishers (RD) and (RO) deffer in free sulfite ion concentrations, bromide ion concentrations and pH, wherein the method comprises adding replenisher (RD) during the development-processing operation in a supplemental amount in proportion to the size of the film processed, the degree of exposure of the film processed and the percentage of the exposed area of the film processed and, prior to the start of each development-processing operation, adding replenisher (RO) in a supplemental amount previously determined (a) depending upon (i) the time interval from the suspension of the development processing operation of the automatic developing machine when last operated to the start of the development-processing operation of the automatic developing machine and (ii) the temperature at which the lithographic developer was kept during the time interval (i), where replenisher (RO) was added during the previous development-processing operation of the automatic developing machine, or (b) depending upon (i') the time interval from the start of the development-processing operation of the automatic developing machine when last operated to the start of the development processing operation of the automatic developing machine and (ii') the temperature at which the lithographic developer was kept during the time interval (i'), where no replenisher (RO) was added during the previous development-processing operation of the automatic developing machine.

BRIEF DESCRIPTIONS OF THE DRAWINGS

FIG. 1 and FIG. 2 illustrate graphically the relationship between the decrease in the development activity and the time interval of suspension of the development opration, and the relationship between the decrease in the development activity and the temperature at which the developer was kept during the time interval of suspension of the development operation, respectively.

DETAILED DESCRIPTION OF THE INVENTION

Figure 1:
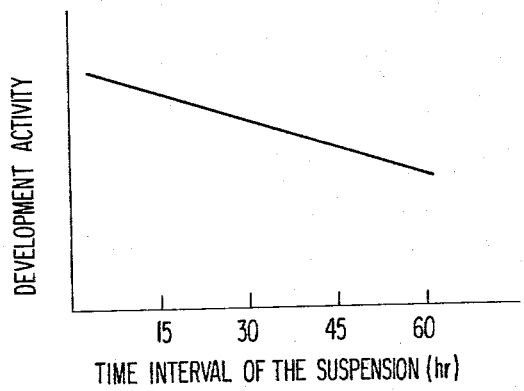

The present invention is utilized for silver halide lithographic photosensitive materials, e.g., for making photolithographic plates (hereinafter called "litho-films") which are development-processed using a so-called infectious developer (hereinafter called a "litho-developer" and often herein simply "developer") and an automatic developing machine. Therefore, the detailed descriptions appearing hereinafter is with respect to litho-films and litho-developers. Since a litho-developer has an exceedingly high tendency toward aerial oxidation with the passage of time, maintaining the development activity of a ligho-developer constant by restoring the development activity decreased by exhaustion due to the passage of time, mostly caused by aerial oxidation, to the initial level is important.

A litho-developer is an aqueous alkaline processing solution containing principally a dihydroxybenzene type developing agent and a sulfite and, further, containing free sulfite ions.

Suitable litho-developing agents which can be used in a litho-developer can be appropriately chosen from dihydroxybenzenes, which are well known in the photographic art. Specific examples of dihydroxybenzenes which can be used include hydroquinone, chlorohydroquinone, bromohydroquinone, isopropylhydroquinone, toluhydroquinone, methylhydroquinone, 2,3-dichlorohydroquinone, 2,5-dimethylhydroquinone and other p-dihydroxybenzenes. Of these, hydroquinone is particularly preferred.

These developing agents may be used individually or as combinations thereof. The developing agent is employed in an amount of about 5 to about 50 g, and preferably, 10 to 30 g, per liter of the developer. The developer must be alkaline when used, as is well known in the photographic art. Therefore, the pH of the developer is adjusted to a pH of higher than about 8 and, preferably, from 9 to 11. The kind and the amount of alkali agent to be used are not particularly restricted.

Examples of sulfites which can be employed to prepare a litho-developer containing a high concentration of free sulfite ions include sodium sulfite, potassium sulfite, potassium metabisulfite and other alkali metal bisulfites commonly used in the photographic art.

Although the free sulfite ion concentration of the developer is not particularly limited, a concentration of not more than about 6 g per liter of the developer is preferred.

The litho-developer can contain additional components as set forth below, in addition to the above-described components. These components can be incorporated into a litho-developer during the preparation thereof, after the preparation thereof but prior to use or during the development-processing.

One additional component is a sulfite ion buffer which is added to the litho-developer in such an amount that a constant sulfite ion concentration is achieved. Specific examples of sulfite ion buffers which can be used include aldehyde-alkali metal bisulfite addition products such as a formaldehyde-sodium bisulfite addition product, ketone-alkali metal bisulfite addition products such as an acetone-sodium bisulfite addition product, carbonyl bisulfite-amine condensation products such as sodium bis(2-hydroxyethyl)aminomethane sulfonate and so on. The amount of the sulfite ion buffer employed can range from 0 to about 130 g, preferably, 30 to 60 g, per liter of the developer.

The litho-developer can also contain water soluble acids (e.g., acetic acid and boric acid), water soluble alkalis (e.g., sodium carbonate and sodium hydroxide), pH buffers such as salts (e.g., sodium carbonate), and a development controlling agent such as an alkali metal halide (e.g., potassium bromide). Certain alkalis can not only render the litho-developer alkaline but also act as a pH buffer agent and a development controlling agent. Furthermore, the litho-developer can also contain an antioxidant such as ascorbic acid, or primary or secondary alkanolamines (e.g., diethanolamine); an organic anti-foggant such as benzotriazole, 1-phenyl-5-mercaptotetrazole, etc.; a water softener such as ethylenediaminetetraacetic acid, nitrilotriacetic acid, etc.; polyalkylene oxides; amine compounds; and organic solvents such as triethylene glycol, dimethylformamide, methyl alcohol, Cellosolve or the like, each in conventionally used amounts.

Of the above-described components for a litho-developer, in the present invention it is only necessary for the essential components to be present at the time of development, and any form can be used. For instance, each of components can be separately dissolved in an appropriate solvent prior to use and they are then mixed at the time of development, or all components can be previously mixed together in the form of a powder or a solution thereof. Also, a mixed solution of the components may be stored as a concentrate or mixed solutions each containing some of the components may be stored as concentrates and combined on use.

The compounded chemicals are optionally dissolved into or diluted with water upon the use thereof.

Typical examples of litho-developers are disclosed in, for instance, U.S. Pat. Nos. 3,622,330, 3,325,286, 3,158,483, 3,142,568 and 3,030,209.

In case of development-processing of litho-films using a litho-developer as described above and an automatic developing machine, in the present invention, the development activity of the litho-developer is maintained constant by adding a supplemental amount of the replenisher (RD) to compensate for process exhaustion, which results in a decrease in the development activity caused by the development processing of litho-films (hereinafter"process exhaustion replenisher (RD)"), and on the other hand, by adding a supplemental amount of the replenisher (RO) to compensate for time-passage exhaustion, which results in a decrease in the development activity caused by the passage of time (mainly due to aerial oxidation) (hereinafter "time-passage exhaustion replenisher (RO)"), wherein these two kinds of replenishers (RD) and (RO) differ in sulfite ion concentrations, bromide ion concentrations and pH.

The replenisher compositions contain substantially the same components as those present in the litho-developer described above. However, different concentrations of some or all of the components are used. Important components in the replenisher compositions are (1) a developing agent (e.g., hydroquinone), (2) a bromide (e.g., potassium bromide, sodium bromide or the like) and (3) free sulfite ions. In addition, (4) the pH is an important factor in the replenishers.

In the present invention, the process exhaustion replenisher, replenisher (RD), contains (1) a higher concentration of the developing agent, (2) a lower concentration of bromide ion, (3) a higher free sulfite ion concentration and (4) a higher pH, in comparison with the litho-developer.

On the other hand, the time-passage exhaustion replenisher, replenisher (RO), contains (1) a higher concentration of the developing agent, (2) a substantially identical concentration of bromide ion (e.g., within a range of ±20% by weight), (3) a higher free sulfite ion concentration and (4) a lower pH, in comparison with the litho-developer.

In comparing the process exhaustion replenisher (RD) with the time-passage exhaustion replenisher (RO), the following important characteristics exist: (1) the developing agent concentration of the process exhaustion replenisher (RD) may be the same as or different from that of the time-passage exhaustion replenisher (RO), (2) the bromide ion concentration of the process exhaustion replenisher (RD) is lower than that of the time-passage exhaustion replenisher (RO) (3) the free sulfite ion concentration of the process exhaustion replenisher (RD) is also lower than that of the time-passage exhaustion replenisher (RO), and (4) the pH of the time-passage exhaustion replenisher (RO) is lower than that of the process exhaustion replenisher (RD).

The concentration of each of the components and the pH in each of the replenishers of the present invention are determined relatively depending upon the concentration of each of the components and the pH in the litho-developer to be used and, therefore, in view of this, it is difficult to set forth unequivocally their respective concentrations and pH's.

However, for the purposes of comparing these characteristics of the replenishers used in this invention in relation to each other and to the lithographic developer, the characteristics set forth in the following table are exemplary.

| | Lithographic Developer | Replenisher (RD) | Replenisher (RO) |
|---|---|---|---|
| Lithographic Developing Agent (g/l) | 10–30 | 20–50 | 20–50 |
| Free Sulfite Ion Concentration (g/l) | 1–6 | 2–7 | 7–20 |
| Potassium Bromide (g/l) | 1–5 | 0–1 | 1–5 |
| pH* | 9–11 | 9–11 | 9–11 |

*The pH of replenisher (RD) is greater than that of the lithographic developer and the pH of the lithographic developer is substantially equal to that of the replenisher (RO).

In addition, since the concentrations of other components in each of the replenishers employed in the present invention, other than the concentration of the developing agent, the bromide ion concentration and the free sulfite ion concentration and the pH as described above, are not limited or restricted, they do not need to be described in detail and they may be the same as or different from those of the litho-developer used.

Next, the term "development activity" as used in the description of the present invention will be illustrated below. The development activity cannot be expressed as a numerical value by only one, easy measurement, unlike the pH or so. The description to "maintain the development activity constant" as used herein means that the concentrations of each of the essential components, namely, the developing agent, the bromide ion and the free sulfite ion, and the pH of the litho-developer used is kept substantially identical to those of the fresh litho-developer which results in the ability to achieve photographic characteristics identical with those which were obtained using the fresh litho-developer.

The term "substantially identical" as used herein means that the concentrations of the essential components and the pH each is within the respective range wherein photographic characteristics, for example, the sensitivity, the dot quality, the half-tone gradation and/or the phenomena called "black spot or comet" in this art (e.g., as described in Japanese Patent Application (OPI) No. 20527/1973 (corresponding to British Patent No. 1,365,236), page 4, line 15–20) are at a level identical to that which is obtained by the fresh litho-developer. Accordingly, whether or not the development activity is maintained constant can be evaluated by a chemical analysis of the essential constituent elements or from a comparison of photographic characteristics, as hereinafter described in detail.

In general, a litho-developer is prepared by mixing a portion containing, as a main component, a developing agent (hereinafter designated portion (A)) with another portion containing, as a main component, an alkali agent (hereinafter designated portion (B)) just before use, because a litho-developer is particularly easily subject to aerial oxidation. Likewise in a replenisher, it is preferred to add a mixture of portion (A) and portion (B) to the litho-developer as soon as possible after the mixing thereof. For example, in U.S. Pat. No. 4,025,344 and in German Patent Application (OLS) No. 2,343,242, a replenisher is prepared just before addition by mixing a portion (A) and a portion (B) and optionally, water, in the respective amounts required to supplement the litho-developer and then, all of the replenisher prepared is added to the litho-developer in the tank of an automatic developing machine; or portion (A) and portion (B) are directly added to the litho-developer without prior mixing of these two portions.

In the present invention, the manner of addition of the process exhaustion replenisher (RD) is not particularly restricted and, therefore, it can be added in any manner generally used in this art.

For instance, the quantity of the process exhaustion replenisher (RD) can be determined by monitoring the blackened area of a processed film and then, determining the amount of the process exhaustion replenisher (RD) needed in proportion to the blackened area, or the quantity of the process exhaustion replenisher (RD) can be previously determined from the kind, size and exposure of the film to be processed, which quantity of the process exhaustion replenisher (RD) is added after the processing of each sheet of film. Also, in the case of roll films, a prescribed amount of process exhaustion replenisher (RD) may be added at constant time intervals (e.g., at constant time intervals ranging from 30 sec to several minutes) depending on the amount of films processed.

These addition methods can be carried out with reference to the descriptions as disclosed in, for example, U.S. Pat. Nos. 3,529,529, 3,532,047, 3,334,566, 3,554,109 and 4,025,344.

A remarkable feature of the present invention is that the time-passage exhaustion replenisher (RO) can be added in a simple and practical manner.

More specifically, when the operation of an automatic developing machine has been suspended and the operation is again started sometime later, the time-passage exhaustion replenisher (RO) is added in a supplemental amount which can be previously determined depending upon the time interval of the suspension of the automatic developing machine and the ambient temperature at which the developer is maintained during the time interval of the suspension. On the other hand, replenishment with the process exhaustion replenisher (RD) plays an important roll during the operation of the automatic developing machine. Concerning the time-passage exhaustion which occurs in the litho-developer during operation of the automatic developing machine, various simple replenishing methods can be employed, because the extent of exhaustion of a litho-developing attributable to the passage of time during operation is much smaller than that attributable to the processing, although it is not negligibly small. For instance, in a similar manner as disclosed in German Patent Application (OLS) No. 2,044,893 and U.S. Pat. No. 4,025,344, during operation of an automatic developing machine, a prescribed amount of a replenisher to compensate for developer exhaustion due to the passage of time is added at regular time intervals during periods when the automatic developing machine is being used, i.e., films are being processed, or during periods of interruption when the automatic developing machine is in operation but no films are being processed, i.e., during stand-by periods, e.g., within the range of 10 minutes to 4 hours, perferably, 30 minutes to 3 hours, or supplemental quantities may be added initially at the start of the operation after the interruption thereof.

In addition, the above-described supplemental amount of the replenisher to compensate for the passage of time is previously determined depending only upon the time interval which has elapsed, regardless of the quantity of films treated. Processes for determining this supplemental quantity are illustrated hereinafter.

The term "interruption of operation" is used herein to describe the situation where the automatic developing machine is running, but no films are being processed, (i.e., stand-by operation) and the term "suspension of operation" is used herein to describe the situation where the automatic developing machine is turned off with developer being allowed to remain in the automatic developing machine.

Where the operation of an automatic developing machine has been suspended, the time-passage exhaustion replenisher (RO) is not added at all to the litho-developer used during the period of suspension, but it is added in a supplemental amount which is determined by the time interval of the suspension and the ambient temperature during the time interval of suspension when the automatic developing machine is next operated.

Each of the supplemental quantities of the time-passage exhaustion replenisher (RO) to be added in the course of the operation and at the end of period of suspension of an automatic developing machine can be easily determined depending on the automatic developing machine, the composition of the litho-developer and the composition of the time-passage replenisher (RO). For instance, where a developer having an initial composition is put in a tank of an automatic developing machine and such is operated for a short while, e.g., for 2 hours, and as a result, the developer becomes exhausted, the quantity of time-passage exhaustion replenisher (RO) to be supplemented in order to restore the developer, which has thus changed, to the initial level can be determined by chemically analyzing the resulting exhausted developer. Similarly, where operation of the automatic developing machine has been stopped for a short while, e.g., for 2 hours, and the developer is left in the tank thereof during that time and, as a result, the developer is exhausted, the quantity to be supplemented in order to restore the developer, which has been changed, to the initial level can be also determined by a chemical analysis of the resulting exhausted developer. The temperature at which the developer is kept during the interval of suspension of operation of the automatic developing machine depends upon the ambient temperature of the automatic developing machine. Therefore, the developer which deteriorates by being left in the tank of the automatic developing machine for a prescribed time is stored at a wide variety of temperatures. The developers obtained are then chemically analyzed using techniques generally employed in the photographic art to determine the quantity of replenisher necessary to restore the developer to the initial level at each ambient temperature. However, a constant ambient temperature may be achieved throughout the year by thermostatically controlling the ambient temperature or in a room lacking such an equipment, since the difference in the extent of deterioration resulting from differences in ambient temperature is not so sharp, the year may be divided into 2 or 3 seasons and a respective ambient temperature for each season is established. Under these approximate conditions, the quantity of the time-passage exhaustion replenisher (RO) to be supplemented can be determined with an accuracy adequate for practical use.

Various analytical techniques can be employed for the chemical analysis of developers and replenishers. For instance, G. Russell, *Chemical Analysis in Photography*, page 205–225, Focal Press (1965) describes suitable techniques which can be used.

In addition to chemical analytical techniques for determining the supplemental quantity of the replenisher required, the development activity can be also restored by adding the replenisher in an amount determinable from a comparison of photographic characteristics.

More specifically, the quantity of replenisher required for restoring the photographic characteristics (e.g., the sensitivity, the gradation, the dot quality, the half-tone gradation and freedom from black spot) to the level obtained by processing with a developer having an initial composition can be routinely determined by trial and error.

Figure 2:
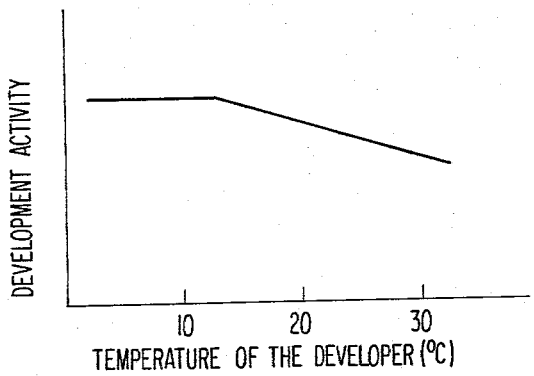

The decrease in development activity (1) where the developer is left in the tank of an automatic developing machine while operation of the automatic developing apparatus is suspended for a variable time yet the temperature of the developer is kept constant and (2) where the developer put in the tank of an automatic developing machine while the operation of the automatic developing machine is suspended for a prescribed time and the temperature is changed is shown graphically in FIG. 1 and FIG. 2, respectively. As can be seen from these figures, the decrease in the development activity of the developer can be correlated to the time interval of the suspension of the operation of the automatic developing machine and the temperature of the developer during the time interval of suspension thereof and, further, each of the relationships between the decrease in the development activity and the suspension time, and between the decrease in the development activity and the temperature of the developer at a temperature higher than 10° C. can be regarded as approximately linear. When the time interval of suspension of operation is prolonged over a certain extent, the temperature of the developer comes to equal the ambient temperature. Accordingly, the temperature of the developer may be considered to be that of the ambient temperature without any large discrepancy occurring. Accordingly, the supplemental quantity of the time-passage exhaustion replenisher (RO) (R, in liters) to the decrease in the development activity during the period of suspension of the automatic developing machine can be represented by the following relationship, wherein T (in hours) is the time interval of suspension, and t (in °C.) is the ambient temperature:

(I) When t is above 10° C., $$R=\alpha\cdot T\ t-10/10$$

(II) When t is above 0° C. and 10° C. or less, $$R=\alpha\cdot T/10$$

wherein $\alpha$ is a constant depending upon the nature of the automatic developing machine used, e.g., agitation method, film transport method, etc., the ratio of the surface area of the developing tank to the volume thereof, the developer composition, the kind of photosensitive film, the average number of films which have been development-processed and so on, and can be determined experimentally in a conventional manner. For example, when the supplemental quantity of the time-passage exhaustion replenisher (RO) was determined to be 1.4 liters in a conventional manner, for example, using a control film strip, under conditions of a period of suspension of 14 hours and an ambient temperature of 25° C., the following value can be obtained as the value of $\alpha$, $$\alpha=R/T\cdot 10/t-10=(1.4\times 10)/(14\times 15)=0.067$$

Accordingly, the supplemental quantity of the time-passage exhaustion replenisher (RO) under the conditions of a temperature of 23° C. and a period of suspension of 38 hours can be calculated as 3.3 liters using the $\alpha$ value obtained above as follows:

$$R=0.067\times 38\times 13/10=3.3$$

While such calculations may be done as the occasion demands, it is convenient to determine previously calculated R values under various appropriate conditions and put them in a table or plot them graphically because the above-described relationship contains only the period of suspension and the ambient temperature as variables in a series of development-processings using combinations of a specific automatic developing machine, a specific developer and a specific kind of film.

Of course, the $\alpha$ value must be determined for each system since the $\alpha$ value will vary even if only one of the automatic developing machine, the developer and the kind of film to be used is changed. However, once the $\alpha$ value has been determined, R values can be calculated simply from the above-described relationship. Therefore, this method is of great advantage in the photolithographic plate-making art wherein a large number of films of the same kind are processed using the same kind of developer and the same type of automatic developing machine. As was described above, where the supplemental quantity per unit time (e.g., per hour) has been initially determined for a specific developer/replenisher/automatic developing machine system under each of the conditions to be used, namely, whether the operation of the automatic developing machine is continued or suspended, the supplemental amount to be added in each case of different time periods of duration of operation and/or different periods of suspension of operation can be obtained by a simple proportional calculation. The thus-obtained amount of replenisher is added at regular time intervals or at the time the development operation is started, resulting in a restoration of the developer and the development activity to the initial level at regular time intervals. Thus, the development activity can be maintained constant without the need for skillful personnel or expensive monitors. Therefore, the present method is of great advantage from a practical point of view.

In the present invention, the thus-determined supplemental amount of time-passage exhaustion replenisher (RO) may be added to the developer manually or automatically, e.g., using an automatic supply apparatus equipped with a timer controlling the supplemental quantity of the time-passage exhaustion replenisher (RO) as a function of time.

Litho-films which can be used in the present invention are illustrated below. A lithographic film or lith-film can, in general, be described as a photographic film comprising a support having thereon a silver halide emulsion layer where the silver halide contains above about 50 mol% of silver chloride and at the same time is one having an ability to produce a high contrast image of a $\gamma$ value of about 4 upon development with a so-called lith-developer as described hereinbefore. Preferred silver halide emulsions are those containing silver chlorobromide and silver chloroiodobromide and more particularly, those which contain about 50 to 90 mol% silver chloride, about 10 to 50 mol% silver bromide and about 0 to 5 mol% silver iodide. The most preferred litho-films are those with silver halide emulsions containing silver halides in which more than 70 mol% is silver chloride.

The silver halide emulsions employed can be sensitized with gold compounds, sulfur compounds, reducing agents such as amines, hydrazines and stannous compounds and compounds of noble metals such as iridium, rhodium and the like.

Further, the silver halide emulsion layers and other constituent layers can contain water insoluble high polymers such as polyalkylacrylates, polymethacrylates and the like in a form of a latex, in addition to hydrophilic high polymers such as gelatin.

Moreover, these layers may contain additives for improving the photographic characteristics of litho-films such as polyalkylene oxide derivatives, benzotriazoles, 1,3,3$\alpha$,7-tetrazaindene derivatives and the like.

Various other addenda which can be present and supports which can be employed in the litho-films to which thus invention is applicable are described in *Product Licensing Index,* Volume 92, pages 107–110 (December, 1971).

The present invention is applicable to processing using an automatic developing machine. Examples of automatic developing machines which can be used include those of the opposing roller type, e.g., Pakorol Super-G24-2 (manufactured by PAKO Corp.) and FG-14L (manufactured by Fuji Photo Film Co., Ltd.), those of the zigzag roller type, e.g., Kodalith Processor (manufactured by Eastman Kodak Co.), those which belong to the belt conveyer type, e.g., LD-241D (manufactured by Log Etronics Co., Ltd.) and others such as the Cronalith 24L (manufactured by E. I. du Pont de Nemours & Co., Ind.). Descriptions of various types of automatic developing machines are given in *Graphic Arts Monthly,* 8, 60 (1970).

The present invention will now be illustrated in greater detail by reference to the following examples. However, the invention is not intended to be construed as being limited to these examples. Unless otherwise indicated herein, all parts, percents, ratios and the like are by weight.

EXAMPLE 1

An FG-14L (manufactured by Fuji Photo Film Co., Ltd.) automatic developing machine was used and the photosensitive material used was Fujilith VO-100 (manufactured by Fuji Photo Film Co., Ltd.). The composition of the developer and the composition of the replenishers were as follows:

Developer Composition and Replenisher Composition

| Component | Developer | Replenisher (RD) | Replenisher (RO) |
|---|---|---|---|
| Sodium-Formaldehyde Bisulfite | 50.0 g | 50.0 g | 50.0 g |
| Sodium Sulfite | 3.0 g | 7.0 g | 25.0 g |
| Boric Acid | 7.5 g | 4.3 g | 7.5 g |
| Triethylene Glycol | 50.0 g | 55.0 g | 55.0 g |
| Hydroquinone | 22.5 g | 30.0 g | 30.0 g |
| Potassium Bromide | 2.6 g | 0.4 g | 2.6 g |
| Sodium Carbonate (monohydrate) | 55.0 g | 50.0 g | 50.0 g |
| 2,2'-Iminodiethanol | 18.1 g | 18.1 g | 18.1 g |
| NaOH | 2.0 g | 4.0 g | 1.0 g |
| Water to make | 1 l | 1 l | 1 l |

Replenisher (RD) was employed for restoring developer activity due to exhaustion from processing and Replenisher (RO) was employed for restoring developer activity due to exhaustion from the passage of time.

16 liters of a developer having the above-described composition was put in each of the tanks of two automatic developing machines (designated Automatic Developing Machine No. 1 and Automatic Developing Machine No. 2, respectively), and development-processing was started under the conditions of a developing temperature of 27° C. and a developing time of 2 minutes.

Half of each photosensitive material as described above was covered with an opaque mask, and was then exposed for 10 seconds to light from a tungsten light and then passed into the automatic developing machine. A 30 ml portion of process exhaustion Replenisher (RD) was automatically added to the developer for each sheet of the photosensitive material having a size of 10×12 inches processed.

In the first day, 200 sheets of photosensitive materials were development-processed in an 8-hour period and then, the photographic speed of the used developer was evaluated using a commercially available control film strip. It was found the resulting developer had a photographic speed identical to that exhibited at the beginning of the development (i.e., a photographic speed of that of the fresh developer).

Then, the automatic developing machine was turned off, the operation suspended and it was allowed to stand for 16 hours. On the second day, the automatic developing machines were operated again. The decrease in the sensitivity of the developer which had been left in the tank of Automatic Developing Machine No. 1 was evaluated using the control film strips. The optimum quantity capable of restoring the sensitivity of the exhausted developer to that of the fresh developer was determined by trial and error by repetitive addition of a small amount each time of process exhaustion replenisher (RD) and then, determining the sensitivity thereof using the control film strip. As a result, it was found the sensitivity could be restored only after the addition of a 0.5 liter portion of Replenisher (RD) (control of the developer in a conventional manner).

On the other hand, a one liter porition of the time-passage exhaustion replenisher (RO) was added to the developer which had been left in the tank of Automatic Developing Machine No. 2, resulting in the restoration of the development activity of the exhausted developer to the level of the fresh developer (the control method for the developer in the present invention). This supplemental quantity of 1 liter was determined by chemical analysis prior to the restart of the development operation. After the respective sensitivities of the developers left in each of the two automatic developing machines were restored to the level of the fresh developer using one of the above-described respective procedures, 200 sheets of the above-described photosensitive materials were processed in an 8-hour period using each developing machine. This procedure was repeated each day for 6 days using each developing machine. Then, the photographic characteristics obtained the first day were compared with those obtained the sixth day. The results obtained are shown in Table 1 below.

TABLE 1

| Automatic Developing Machine | Dot Quality | | Half-Tone Gradation | | Black Spots | |
|---|---|---|---|---|---|---|
| | First Day | Sixth Day | First Day | Sixth Day | First Day | Sixth Day |
| No. 1 | 10 | 8 | 1.43 | 1.30 | None | Many |
| No. 2 | 10 | 10 | 1.43 | 1.43 | None | None |

For the evaluation of the dot quality shown in the Table 1 above, a grade of "10" was excellent and "1" was extremely poor. The other grades were visually ranked between these two points.

The half-tone gradation was the range of the logarithm of the exposure required to change a 5% dot area to a 95% dot area. Accordingly, the larger the number is, the softer the half-tone gradation is and, similarly, the smaller the number is, the harder the half-tone gradation is.

Black spot is the phenomena that develops when silver deposits irregularly at unexposed areas and the appearance of a number of black spots is undesirable.

As can be seen from the results in Table 1 above, where the operation of the automatic developing machine was continued when the sensitivity was restored by only adding the process exhaustion replenisher (RD) at the time of restarting the operation after suspension for a short while, as in a conventional manner, on the sixth day the apparent sensitivity could be kept at a level identical to the beginning level, but the dot quality was reduced, the half-tone gradation changed (i.e., worsened) and a number of black spots appeared (See Automatic Developing Machine No. 1). On the other hand, for Automatic Developing Machine No. 2 where the developer which deteriorated due to aerial oxidation was restored to the initial level every day by the addition of the replenisher (RO) at the time of restarting of the operation in accordance with the method of the present invention, a decrease in dot quality, a change in the half-tone gradation and an appearance of black spots were not observed.

EXAMPLE 2

The automatic developing machine used was an FG-14L automatic developing machine (manufactured by Fuji Photo Film Co., Ltd.) and the photosensitive materials used were Fujilith HO-100 and Fujilith HP-100. The composition of the developer and the composition of the replenisher were as set forth below:

Developer and Replenisher Compositions

| Component | Developer | Replenisher (RD) | Replenisher (RO) |
|---|---|---|---|
| Sodium-Formaldehyde Bisulfite | 55.0 g | 55.0 g | 55.0 g |
| Potassium Sulfite | 2.0 g | 8.0 g | 22.0 g |
| Triethylene Glycol | 45.0 g | 50.0 g | 50.0 g |
| Hydroquinone | 18.0 g | 27.0 g | 27.0 g |
| Potassium Bromide | 2.7 g | 0.3 g | 2.7 g |
| Potassium Carbonate | 35.9 g | 35.0 g | 35.0 g |
| Sodium Hydroxide | 4.0 g | 8.0 g | 3.5 g |
| Tetrasodium Ethylenediamine-tetraacetate | 2.0 g | 2.0 g | 2.0 g |
| Water to make | 1 l | 1 l | 1 l |

Replenisher (RD) was employed for restoration due to processing exhaustion and Replenisher (RO) was employed for restoration due to exhaustion from the passage of time.

A 16 liter portion of a developer having the above-described composition was put in each of the tanks of Automatic Developing Machines No. 1 and No. 2, and development-processing was started under the conditions of a developing temperature of 27° C. and a developing time of 1 minute and 45 seconds. Half of each photosensitive material as described above was covered with an opaque mask, and was then exposed for 10 seconds to light from a tungsten light, and then passed into the automatic developing machine. A 30 ml portion of the process exhaustion replenisher (RD) was automatically added to the developer on processing of each sheet of photosensitive material having a size of 10×12 inches.

In the first day, 100 sheets of photosensitive materials were development-processed over a 9-hour period and then the photographic speed of the used developer was determined using a commercially available control film strip. As a result, it was found that the photographic speed of the resulting developer had been maintained identical to that obtained at the beginning of development (that of the fresh developer). Then, the operation of the automatic developing machine was suspended by turning the machine off and it was allowed to stand for 15 hours. In the second day, each of the automatic developing machines were operated again. The quantity required for restoring the photographic sensitivity of the exhausted developer to the photographic sensitivity of the fresh developer was determined by trial and error method by repeating the procedure of adding a little of the process exhaustion replenisher (RD) at a time and then determining the photographic sensitivity of the resulting developer using the control film strip. Thus, it was found that photographic sensitivity could be restored only after the addition of 0.6 liter of the replenisher (RD). On the other hand, 1 liter of the time-passage exhaustion replenisher (RO) was added to the developer which had been left in the tank of Automatic Developing Machine No. 2, resulting in a restoration of the development activity of the exhausted developer to the level of the fresh developer (the supplemental quantity of 1 liter being determined by chemical analysis in advance). After the respective sensitivities of the developers left in each of two automatic developing machines were restored to the level of the fresh developer using the resective procedures described above, 100 sheets of the above-described photosensitive materials were processed over a 9-hour interval using each developing machine while maintaining the development activity constant by adding automatically 30 ml of the process exhaustion replenisher (RD) to the developer composition for the processing of each sheet of photosensitive material of a size of 10×12 inches. Then, the operation of the automatic developing machine was suspended. On the third day, the operation of the automatic developing machine was suspended all day long. On the fourth day, the automatic developing machines were operated again. For Automatic Developing Machine No. 1, the sensitivity of the developer could be restored to the level of the fresh developer by addition of 0.9 liter of the process exhaustion replenisher (RD). On the other hand, for Automatic Developing Machine No. 2, the development activity could be restored to the level of the fresh developer by the addition of a 2 liter (1 l×2) portion of the time-passage exhaustion replenisher (RO). Then, 100 sheets of the photosensitive materials as described above and exposed as described above were processed the same as on the first day and the second day while maintaining the sensitivity of the developer constant by automatic addition of 30 ml of the process exhaustion replenisher (RD) for each sheet of photosensitive material of a size of 10×12 inches. After the conclusion of the processing, the operation was suspended. On both the fifth and the sixth days, operation of the automatic developing machine was suspended all day long. On the seventh day, the operation was restarted. For Automatic Developing Machine No. 1, the photographic sensitivity of the developer could be restored to the level of the fresh developer by the addition of 1.4 liters of the process exhaustion replenisher (RD). On the other hand, for Automatic Developing Machine No. 2, the development activity could be restored to the level of the fresh developer by the addition of a 3 liter (1 l×3) portion of the time-passage exhaustion replenisher (RO). Thereafter, 100 sheets of the photosensitive materials as described above and exposed as described above were processed using each automatic developing machine while maintaining the sensitivity constant by automatic addition of 30 ml of the process exhaustion replenisher (RD) for each sheet developed.

The results set forth in Table 2 below show a comparison of the photographic characteristics obtained in the first day with those obtained in the seventh day.

TABLE 2

| Automatic Developing Machine | Dot Quality | | Half-Tone Gradation | | Black Spot | |
|---|---|---|---|---|---|---|
| | First Day | Seventh Day | First Day | Seventh Day | First Day | Seventh Day |
| No. 1 | 10 | 7 | 1.40 | 1.25 | None | Many |
| No. 2 | 10 | 10 | 1.40 | 1.40 | None | None |

The evaluations in Table 2 above were made in a similar manner to those in Table 1.

As can be seen from the results in Table 2, in Automatic Developing Machine No. 1, where the operation was continued while restoring the sensitivity by only addition of the process exhaustion replenisher (RD) at the time of restarting of the operation after a certain period of suspension in the conventional manner, a reduction in the dot quality occurred, the half-tone gradation changed (i.e., worsened) and a number of black spots appeared in the seventh day. On the other hand, in Automatic Developing Machine No. 2, where the development activity, deteriorated by aerial oxidation, was restored to the initial level every day by addition of the time-passage exhaustion replenisher (RO) at the time of restarting of the operation according to the method of the present invention, no decrease in the dot quality, no change in the half-tone gradation and no appearance of black spots were observed. In addition, after the supplemental quantity required for restoring to compensate for exhaustion resulting from the lapse of 24 hours had initially been determined to be 1 liter, the quantity to be added for an arbitrary time interval passed can be easily determined by the following relationship:

$$1l \times \frac{\text{Time Interval Passed}}{24} = R(l)$$

Thus, the present invention has been proven to be very efficient.

EXAMPLE 3

The automatic developing machine used was an FG-14L automatic developing machine (manufactured by the Fuji Photo Film Co., Ltd.) and the photosensitive material used was Fujilith VO-100 of a size of 10×12 inches. The composition of the developer and the two replenishers were the same as those in Example 1, respectively. 16 liters of a developer having the above-described composition was put in each of the tanks of Automatic Developing Machines No. 1 and No. 2, and development-processing was begun under conditions of a developing temperature of 27° C. and a developing time of 2 minutes. Half of each photosensitive material as described above was covered with an opaque mask, and was then exposed for 10 seconds to light from a tungsten light and then, passed into each of the automatic developing machines. 30 ml of the process exhaustion replenisher (RD) was automatically added to each of the developer for each sheet of photosensitive material of a size of 10×12 inches processed.

On the first day, 200 sheets of the above-described photosensitive materials exposed as described above were development-processed over an 8-hour period and then, the photographic speed of the used developer was determined using a commercially available control film strip. It was found the photographic speed of the resulting developer was maintained identical to that obtained at the beginning of development (that of the fresh developer). Therein, 120 ml of the time-passage exhaustion replenisher (RO) was additionally added to Automatic Developing Machine No. 2 every 2 hours independent of film processed.

Thereafter, the operation of the automatic developing machine was suspended and the automatic developing machine was allowed to stand for 16 hours at an ambient temperature of 25° C. In the second day, the automatic developing machine was operated again. For Automatic Developing Machine No. 1, the photographic sensitivity was examined repeatedly by adding a small amount of process exhaustion replenisher (RD) at a time by trial and error using the control film strips (conventional control of the developer). Not until 0.5 liter total of process exhaustion replenisher (RD) ws added was the photographic sensitivity of the developer restored to the level of the fresh developer.

On the other hand, time-passage exhaustion replenisher (RO) was added in a supplemental amount determined in advance to Automatic Developing Machine No. 2. More specifically, using chemical analysis carried out in advance, 90 ml of the time-passage exhaustion replenisher (RO) was required for restoring the development activity of the developer, which was exhausted by the suspended operation of the automatic developing machine for 2 hours at 25° C. to the level of the fresh developer. Therefore, for a suspension period of 16 hours, the supplemental quantity thereof become 720 ml because $$R\ (l) = 90\ \text{ml} \times 16/2 = 720\ \text{ml}$$

Thus, 720 ml of the time-passage exhaustion replenisher (RO) was added at the time of restarting the operation, resulting in a restoration of the development activity of the developer to the level of the fresh developer (control of the developer using the method of the present invention).

As was described above, the photographic sensitivity and/or the development activity of each of the developers in the two automatic developing machines was restored to a level identical to the beginning sensitivity and/or development activity and then, 200 sheets of the photosensitive materials described above were development-processed over an 8-hour period using each automatic developing machine.

In the above-described process, 120 ml of time-passage exhaustion replenisher (RO) was added to Automatic Developing Machine No. 2 every 2 hours during the operation. These procedures were repeated using each developing machine day after day until the sixth day was over. Then, the photographic characteristics obtained in the first day and those obtained in the sixth day were compared as shown in Table 3 below.

TABLE 3

| Automatic Developing Machine | Sensitivity | | Dot Quality | | Half-Tone Gradation | | Black Spot | |
|---|---|---|---|---|---|---|---|---|
| | First Day | Sixth Day | First Day | Sixth Day | First Day | Sixth Day | First Day | Sixth Day |
| No. 1 | 100 | 100 | 10 | 8 | 1.45 | 1.35 | None | Many |
| No. 2 | 100 | 100 | 10 | 10 | 1.45 | 1.45 | None | None |

For the evaluation of the photographic sensitivity shown in the Table 3 above, the photographic sensitivity of the fresh developer was a grade of 100 and the other grades were ranked relatively.

As can be seen from the results in Table 3 above, where the operation was continued by restoring the photographic sensitivity only by adding process exhaustion replenisher (RD) on restarting the operation using the conventional replenishment method, in the sixth day a decrease in the dot quality occurred, the half-tone gradation changed (i.e., worsened) and a number of black spots appeared. A number of disadvantages from a practical point of view occur in this process. (These phenomena occured in Auomatic Developing Machine No. 1.)

On the other hand, in Automatic Developing Machine No. 2 where the development activity was maintained constant every day by adding time-passage exhaustion replenisher (RO) in a prescribed amount every 2 hours during the operation of the machine and, by adding the same replenisher in an amount previously determined depending upon the time of suspension in the operation and the ambient temperature according to the method of the present invention at the time of restarting of the operation, no decrease in dot quality, no change in the half-tone gradation and no appearance of a number of black spots were observed. In addition, after the supplemental quantity of the time-passage exhaustion replenisher (RO) had initially been determined per unit time, the quantity to be supplemented can be determined in advance by a simple proportional calculation. Thus, the present invention was proven to have a greater advantage from a practical point of view.

EXAMPLE 4

The automatic developing machines used were FG-14L automatic developing machine (manufactured by Fuji Photo Film Co., Ltd.) and the photosensitive materials used were Fujilith HO-100 and Fujilith HP-100 (both of which were manufactured by the Fuji Photo Film Co., Ltd.). The compositions of the developer and the replenishers were as set forth below:

Composition of Developer and Replenishers

| Component | Developer | Replenisher (RD) | Replenisher (RO) |
|---|---|---|---|
| Sodium-Formaldehyde Bisulfite | 55.0 g | 55.0 g | 55.0 g |
| Potassium Sulfite | 3.8 g | 9.0 g | 31.3 g |
| Triethylene Glycol | 45.0 g | 50.0 g | 50.0 g |
| Hydroquinone | 18.0 g | 27.0 g | 27.0 g |
| Potassium Bromide | 2.3 g | 0.5 g | 2.3 g |
| Potassium Carbonate | 35.0 g | 35.0 g | 35.0 g |
| Sodium Hydroxide | 4.0 g | 8.0 g | 3.5 g |
| Tetrasodium Ethylenediamine-tetraacetate | 2.0 g | 2.0 g | 2.0 g |
| Water to make | 1 l | 1 l | 1 l |

Replenisher (RD) and Replenisher (RO) have the same meanings, respectively, as in Examples 1, 2 and 3.

16 liters of a developer having the above-described composition was put in each of the tanks of two Automatic Developing Machines No. 1 and No. 2, and development-processing was started under the condition of a developing temperature of 27° C. and a developing time of 1 minute and 45 seconds. Half of each photosensitive material as described above was covered with an opaque mask, and was then exposed for 10 seconds to light from a tungsten light, and then passed into each of the automatic developing machines. 30 ml of the process exhaustion replenisher (RD) was automatically added to each of the developer for every sheet of the photosensitive material of a size of 10×12 inches processed. For Automatic Developing Machine No. 2, 120 ml of time-passage exhaustion replenisher (RO) was additionally added every 2 hours.

On the first day, 100 sheets of the photosensitive materials described above were development-processed in a 6-hour period. Thereafter, the photographic speed of each of the developers used was determined using a commercially available control film strip. The photographic speed of both of the resulting developers was maintained identical to that obtained at the beginning of development (that of the fresh developer).

Then, the operation of each of the automatic developing machines was suspended and the automatic developing machines were allowed to stand for 18 hours at an ambient temperature of 15° C. On the second day, each of the automatic developing machines was operated again. For Automatic Developing Machine No. 1, the photographic sensitivity was determined repeatedly by trial and error using the commercially available control film strips by adding a small amount of process exhaustion replenisher (RD) at a time. Not until 0.6 liter total of the process exhaustion replenisher (RD) had been added was the sensitivity of the developer restored to the level of the fresh developer.

On the other hand, for Automatic Developing Machine No. 2, the development activity could be restored to the level of the fresh developer by adding the time-passage exhaustion replenisher (RO) in a supplemental quantity of 585 ml at the restart of the operation, which supplemental quantity could be determined by calculating as the value corresponding to a suspension period of 18 hours on the basis of a unit value of 65 ml per 2 hours of suspension (which value had been determined by chemical analysis in advance). After the development activity had been restored in each of the developers using each of the respective processes above, 100 sheets of the above-described films were development-processed in a 6-hour period in each automatic developing machine. 30 ml of the process exhaustion replenisher (RD) was automatically added to each of the developers for the processing of each sheet of photosensitive material of a size of 10×12 inches. Furthermore, for Automatic Developing Machine No. 2, 120 ml of the time-passage exhaustion replenisher (RO) was additionally added every 2 hours.

Thereafter, the operation of each automatic developing machine was suspended. On the third day, operation of each of the automatic developing machines was suspended all day long. On the fourth day, the automatic developing machines were operated again. For Automatic Developing Machine No. 1, the photographic sensitivity of the developer could be restored to the level of the fresh developer by addition of 0.9 liter of the process exhaustion replenisher (RD). On the other hand, for Automatic Developing Machine No. 2, the development activity could be restored to the level of the fresh developer by adding the time-passage exhaustion replenisher (RO) in a supplemental quantity of 1365 ml at the time of the restart of the operation, which quantity was obtained by calculating the value corresponding to a suspension period of 42 hours on the basis of a unit value of 65 ml per 2 hours of suspension.

Then, 100 sheets of the above-described films were development-processed in each automatic developing machine as on the first day and the second day, wherein 30 ml of the process exhaustion replenisher (RD) was automatically added to each of the developers for each sheet of a size of 10×12 inches and, furthermore, for Automatic Developing Machine No. 2, 120 ml of the time-passage exhaustion replenisher (RO) was additionally added every 2 hours.

Thereafter, the operation of each automatic developing machine was suspended. Operation of the automatic developing machines was suspended all day long for both the fifth day and the sixth day. On the seventh day, the automatic developing machines were operated again. For Automatic Developing Machine No. 1, the photographic sensitivity of the developer could be restored to the level of the fresh developer by addition of 1.4 liters of the process exhaustion replenisher (RD). On the other hand, for Automatic Developing Machine No. 2, the development activity could be restored to the level of the fresh developer by adding the time-passage exhaustion replenisher (RO) in a supplemental quantity of 2145 ml at the time of the restart of the operation, which quantity was obtained by calculating the value corresponding to a suspension period of 66 hours on the basis of a unit value of 65 ml per 2 hours of suspension. Then, 100 sheets of the above-described films were development-processed in each of the automatic developing machines, wherein, in order to maintain the photographic sensitivity constant, 30 ml of the process exhaustion replenisher (RD) was automatically added to each of the developers for each sheet of a size of 10×12 inches and, furthermore, for Automatic Developing Machine No. 2, 120 ml of the time-passage exhaustion replenisher (RO) was additionally added every 2 hours. The results as set forth in Table 4 below show a comparison of the photographic characteristics obtained on the first day with those which were obtained on the seventh day.

TABLE 4

| Automatic Developing Machine | Dot Quality | | Half-Tone Gradation | | Black Spot | |
|---|---|---|---|---|---|---|
| | First Day | Seventh Day | First Day | Seventh Day | First Day | Seventh Day |
| No. 1 | 10 | 7 | 1.44 | 1.25 | None | Many |
| No. 2 | 10 | 10 | 1.44 | 1.44 | None | None |

As can be seen from the results in Table 4 above, in Automatic Developing Machine No. 1 where the operation was continued while the photographic sensitivity was restored by only addition of the process exhaustion replenisher (RD) at the time of restarting of the operation in the conventional manner, a decrease in the dot quality occurred, the half-tone gradation changed (i.e., worsened), and a number of black spots appeared on the seventh day. On the other hand, in Automatic Developing Machine No. 2, the deterioration due to aerial oxidation could be restored to the initial level by adding time-passage exhaustion replenisher (RO) in a prescribed amount every 2 hours during the operation of the automatic developing machine, and by adding the same replenisher in the amount previously determined depending upon the period of suspension of the operation and the ambient temperature according to the method of the present invention at the time of restarting the operation. No decrease in the dot quality, no change in the half-tone gradation and no appearance of a number of black spots were observed. In addition, after the supplemental quantity of the time-passage exhaustion replenisher (RO) had initially been determined per unit time, the quantity to be supplemented for an arbitrary period of suspension can be easily determined in advance by a simple proportional calculation. Thus, the present invention has been proven to be efficient.

EXAMPLE 5

The automatic developing machine used was an FG-24 Processor (manufactured by the Fuji Photo Film Co., Ltd.), and the photosensitive material used was Fujilith VO-100 of a size of 10×12 inches. Concentrates of a developer (in two parts), concentrates of a process exhaustion replenisher (RD) (in two parts) and concentrates of a time-passage exhaustion replenisher (RO) (in two parts) were prepared separately. The compositions of these developers and replenishers are set forth below:

Composition of Concentrated Developer and Replenishers-Part A

| Component | Developer | Replenisher (RD) | Replenisher (RO) |
|---|---|---|---|
| Tetrasodium Ethylenediamine-tetraacetate | 1.0 g | 1.0 g | 1.0 g |
| Sodium-Formaldehyde Bisulfite | 53.0 g | 53.0 g | 53.0 g |
| Triethylene Glycol | 40.0 g | 50.0 g | 50.0 g |
| Hydroquinone | 18.0 g | 25.0 g | 25.0 g |
| Water to make | 167 ml | 167 ml | 167 ml |

Composition of Concentrated Developer and Replenishers-Part B

| Component | Developer | Replenisher (RD) | Replenisher (RO) |
|---|---|---|---|
| Tetrasodium Ethylenediamine-tetraacetate | 1.0 g | 1.0 g | 1.0 g |
| Potassium Carbonate | 30.0 g | 33.0 g | 33.0 g |
| Potassium Bromide | 2.5 g | 0.5 g | 2.5 g |
| Potassium Sulfite | 3.0 g | 9.0 g | 25.0 g |
| 2,2'-Iminodiethanol | 15.0 g | 15.0 g | 15.0 g |
| Sodium Hydroxide | 3.0 g | 6.0 g | 3.0 g |
| Water to make | 167 ml | 167 ml | 167 ml |

Replenisher (RD) was employed for restoring developer activity due to exhaustion from the processing and Replenisher (RO) was employed for restoring developer activity due to exhaustion from the passage of time.

The above-described Developer Composition Part A, Developer Composition Part B and water were mixed to prepare a diluted developer for use in a mixing ratio of 1:1:4 by volume (in that order). 34 liters of the dilute developer was put in each of the tanks in two Automatic Developing Machine No. 1 and No. 2, and development-processing was started under the conditions of a developing temperature of 27° C. and a developing time of 1 minute and 45 seconds. Half of each photosensitive material as described above was covered with an opaque mask, and was then exposed for 10 seconds to light from a tungsten light, and then passed into each of the automatic developing machines. 5 ml of Replenisher (RD)-Part A, 5 ml of Replenisher (RD)-Part B and 20 ml of water were added automatically to each of the developers for each sheet of the photosensitive material of a size of 10×12 inches. For Automatic Developing Machine No. 2, 250 ml of a dilute replenisher, which was prepared by mixing Replenisher (RO)-Part A, Replenisher (RO)-Part B and water in a mixing ratio of 1:1:4 by volume (in that order), was furthermore added every 2 hours.

On the first day, 200 sheets of the above-described photosensitive materials were development-processed in an 8-hour period under the above-described operating conditions. The photographic speed of each developer was examined using a commercially available control film strip. The photographic speed of both of the resulting developers was maintained identical to that obtained at the beginning of development (that of the fresh dilute developer). Then, the operation of the automatic developing machines each was suspended and the automatic developing machines were allowed to stand for 16 hours at an ambient temperature of 25° C. On the second day, each of the automatic developing machines was operated again. For Automatic Developing Machine No. 1, the photographic sensitivity was examined repeatedly by trial and error using control strips by adding a small amount of the dilute process exhaustion replenisher (RD) at a time. Not until a total 1.5 liters of the dilute process exhaustion replenisher (RD) was the photographic sensitivity restored to the level of the fresh dilute developer. On the other hand, for Automatic Developing Machine No. 2, the development activity could be restored to the level of the fresh dilute developer by adding a dilute replenisher, which was obtained by mixing Replenisher (RO)-Part A, Replenisher (RO)-Part B and water in a mixing ratio of 1:1:4 by volume (in that order), in a supplemental quantity of 1.6 liters at the time of restarting the operation, which quantity could be determined by calculating the value corresponding to a period of suspension of 16 hours on the basis of a unit value of 200 ml per 2 hours of suspension (which had been determined by chemical analysis in advance). These procedures were repeated every day until after sixth days. Then, the photographic characteristics obtained on the first day and those obtained on the sixth day were determined and compared. The results obtained are shown in Table 5 below.

TABLE 5

| Automatic Developing Machine | Dot Quality | | Half-Tone Gradation | | Black Spot | |
|---|---|---|---|---|---|---|
| | First Day | Sixth Day | First Day | Sixth Day | First Day | Sixth Day |
| No. 1 | 10 | 8 | 1.43 | 1.35 | None | Many |
| No. 2 | 10 | 10 | 1.43 | 1.43 | None | None |

As can be seen from the results in Table 5 above, in Automatic Developing Machine No. 1 where the operation was continued while restoring the sensitivity only by addition of the process exhaustion replenisher (RD) at a time of restarting the operation in a conventional manner, a decrease in the dot quality occurred, the half-tone gradation changed (i.e., worsened) and a number of black spots appeared in the sixth day. On the other hand, in Automatic Developing Machine No. 2 where the activity of the developer deteriorated due to aerial oxidation was restored to the initial level by adding the time-passage exhaustion replenisher (RO) in a prescribed amount every 2 hours during the operation of the machine and, by adding the same replenisher in an amount previously determined depending upon the period of suspension of the operation and the ambient temperature according to the method of the present invention at a time of restarting of the operation, no decrease in the dot quality, no change in the half-tone gradation and no appearance of a number of black spots were observed. In addition, after the supplemental quantity of the time-passage exhaustion replenisher (RO) has initially been determined per unit time, the quantity to be supplemented for an arbitrary period of suspension can be easily determined by a simple proportional calculation. Thus, the method of the present invention has been proven to be very efficient.

While the invention has been described in detail and with reference to specific embodiments thereof, it will be apparent to one skilled in the art that various changes and modifications can be made therein without departing from the spirit and scope thereof.

What is claimed is:

1. In a method for processing silver halide lithographic photosensitive materials with a lightographic developer using an automatic developing machine, the improvement comrising maintaining constant the development activity of the lithographic developer by adding supplemental amounts of two kinds of replenishers to the lithiographic developer with a replenisher (RD) being employed to compensate for the decrease in the development activity of the lithographic developer resulting from the development-processing of lithographic photosensitive materials and a replenisher (RO) being employed to compensate for the decrease in the development activity of the lithographic developer resulting from the passage of time, where replenishers (RD) and (RO) differ in free sulfite ion concentrations, bromide ion concentrations and pH, wherein the method comprises adding replenisher (RD) during the development-processing operation in a supplemental amount in proportion to the size of the film processed, the degree of exposure of the film processed and the percentage of the exposed area of the film processed and, prior to the start of each development-processing operation, adding replenisher (RO) in a supplemental amount previously determined (a) depending upon (i) the time interval from the suspension of the development-processing operation of the automatic developing machine when last operated to the start of the development-processing operation of the automatic developing machine and (ii) the temperature at which the lithographic developer was kept during the time interval (i), where replenisher (RO) was added during the previous development-processing operation of the automatic developing machine, or (b) depending upon (i') the time interval from the start of the development-processing operation of the automatic developing machine when last operated to the start of the development processing operation of the automatic developing machine and (ii') the temperature at which the lithographic developer was kept during the time interval (i'), where no replenisher (RO) was added during the previous development-processing operation of the automatic developing machine.

2. The method of claim 1, wherein replenisher (RO) is added at regular time intervals during periods of operation of the automatic developing machine and during periods of suspension of operation of the automatic developing machine.

3. The method of claim 2, wherein the amount of replenisher (RO) added is independent of the amount of lithographic photosensitive materials development-processed.

4. The method of claim 2, wherein said replenishers (RD) and (RO) contain free sulfite ion and bromide ion, and wherein replenisher (RO) has a higher concentration of free sulfite ion, a higher concentration of bromide ion and a lower pH than replenisher (RD).

5. The method of claim 2, wherein replenisher (RD) and replenisher (RO) each contains a lithographic developing agent, sulfite ion, bromide ion and are alkaline, and wherein replenisher (RD) contains said lithographic developing agent, said sulfite ion and said bromide ion in an amount of about 20 to about 50 g/l, about 7 g/l or less, and about 1 g/l or less, as potassium bromide, respectively, of said replenisher (RD) and said replenisher (RD) has a pH of about 9 to about 11; and wherein said replenisher (RO) contains said lithographic developing agent, said sulfite ion and said bromide ion in an amount of about 20 to about 50 g/l, about 7 g/l or greater, and about 1 g/l or greater, as potassium bromide, respectively, of said replenisher (RO) and said replenisher (RO) has a pH of about 9 to about 11.

6. The method of claim 1, wherein the supplemental amount of replenisher (RO) added is all added at the beginning of the start of each development operation after each suspension.

7. The method of claim 6, wherein the amount of replenisher (RO) added is proportional to the temperature of the lithographic developer used in and the time during the operation of the automatic developing machine and is proportional to the ambient temperature of the lithographic developer and the interval of suspension during suspension of the operation of the automatic developing machine.

8. The method of claim 1, wherein the supplemental amount of replenisher (RO) is determined by the relationship $$R=\alpha\cdot T\,t-10/10$$

where the temperature at which the developer is kept is above 10° C. and by the relationship $$R=\alpha\cdot T/10$$

where the temperature at which the developer is kept is above 0° C. and 10° C. or less, wherein R is the supplemental amount of replenisher (RO), T is the time interval (i), t is the temperature at which the developer is kept during the interval (i), and $\alpha$ is an experimentally determined constant.

* * * * *